US006382618B1

(12) United States Patent
Takada

(10) Patent No.: US 6,382,618 B1
(45) Date of Patent: May 7, 2002

(54) SHEET CONVEYING APPARATUS AND IMAGE FORMING APPARATUS

(75) Inventor: Hideaki Takada, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/576,532

(22) Filed: May 23, 2000

(30) Foreign Application Priority Data

May 25, 1999 (JP) ..... 11-145132

(51) Int. Cl.[7] ..... B65H 5/00

(52) U.S. Cl. ..... 271/10.01; 271/258.01; 271/265.01

(58) Field of Search ..... 271/10.01, 10.09, 271/10.11, 258.01, 265.01

(56) References Cited

U.S. PATENT DOCUMENTS 4,451,027 A * 5/1984 Alper
5,575,466 A * 11/1996 Tranquilla ..... 271/10.03
5,692,742 A * 12/1997 Tranquilla ..... 271/10.03
5,848,784 A * 12/1998 Tranquilla ..... 271/10.03
5,870,114 A 2/1999 Numata et al. ..... 347/16
5,966,158 A 10/1999 Ebata et al. ..... 347/104
6,076,821 A * 6/2000 Embry et al. ..... 271/10.01

* cited by examiner

*Primary Examiner*—David H. Bollinger
(74) *Attorney, Agent, or Firm*—Fitzpatrick, Cella, Harper & Scinto

(57) ABSTRACT

This invention provides a sheet conveying apparatus and an image forming apparatus excellent in reliability which maintain high productivity and yet can quickly detect bad conveyance when it occurs. A sheet feeding sensor is provided near the downstream side of a conveying roller and a retard roller, and a sheet discharge sensor is provided near the upstream side of discharge rollers, and when the length of a sheet in the direction of conveyance thereof is defined as Ls and the conveyance distance between the sheet feeding sensor and the sheet discharge sensor is defined as Lp and the number of sheets conveyed at a time at a spacing of zero (0) between sheets is defined as N, N is set so that Lp>Ls×N, and when the designated number of sheets is equal to or greater than N, N sheets as a set are conveyed at a spacing of zero (0) between the sheets, whereafter N sheets as a set are again conveyed at a predetermined spacing between the sheets detectable by the sensors, and this is repeated.

27 Claims, 4 Drawing Sheets

SHEET CONVEYING APPARATUS AND IMAGE FORMING APPARATUS

BACKGROUND OF THE INVENTION

1. Field of the Invention

This invention relates to a sheet conveying apparatus capable of continuously conveying sheets substantially without gaps, and is applied to an image forming apparatus such as a printer, a facsimile apparatus or a copier.

2. Related Background Art

As image forming apparatuses of this kind, there are, for example, copiers, printers, facsimile apparatuses, etc.

In these image forming apparatuses, there is widely used an apparatus for fixing an unfixed toner image formed and borne on a recording material (a paper leaf member such as a transfer material, photosensitive paper or electrostatic recording paper) correspondingly to desired image information by a transfer method (indirect method) or a direct method by the use of a suitable image making process mechanism of the electrophotographic type, the electrostatic recording type or the like.

Also, use is made of an apparatus of the ink jet type or the like for directly effecting image formation on a recording material by liquid including a dye or a pigment.

As a sheet feeding device for a recording material (hereinafter referred to as the sheet) in such an apparatus, there is a sheet feeding device of the automatic feeding type for selecting a sheet feeding cassette fit for the required kind or size of paper from among a plurality of sheet feeding cassettes containing sheets therein, and automatically supplying the sheets one by one from that sheet feeding cassette with the operation of forming an image.

In a sheet conveying apparatus provided with such a sheet feeding device, detecting means as described below are widely used as means for detecting the leading and trailing ends of the sheet and judging bad conveyance.

A. Lever Type

As shown in FIG. 4A of the accompanying drawings, the leading end of a sheet conveyed along guides pushes down a lever as shown in FIG. 4B of the accompanying drawings, and a flag portion on the opposite side to the center of rotation interrupts a photointerrupter to thereby detect the leading end of the sheet.

The lever portion is clockwisely biased by a spring or gravity to such a degree that the sheet is not buckled.

B. Transmission Type Sensor

This comprises a light emitting element emitting infrared light or the like toward a sheet and a light receiving element disposed in opposed relationship therewith, and detects the presence or absence of the sheet between the two by the quantity of transmitted light.

By the use of such detecting means, sheets are conveyed at predetermined sheet intervals for a designated number of recorded sheets to thereby detect the leading end and trailing end of each sheet, and judge whether the sheet is being appropriately conveyed, and during bad conveyance, the conveyance of the sheet has been stopped and a user has been informed of it so as to execute appropriate processing.

In the case of the prior art as described above, however, the following problems have arisen.

In recent years, digitization has been active and for example, the number of revolutions of a polygon mirror and the driving frequencies of an LED head and an ink jet head have suffered from more technical problems as they increase, and the rise of the cost for the solution thereof occurs.

Consequently, even in apparatuses having the same image forming speed, it is desired to shorten the spacing between sheets as much as possible to thereby increase productivity.

Also, in terms of both energy and the durability of all moved or rotated parts, it is desirable to decrease the image forming speed as much as possible.

However, when the spacing between sheets is made zero or less or approximate thereto, the leading and trailing ends of the sheet becomes undetectable by the aforedescribed detecting means, and the detection of bad conveyance for sheet conveyance becomes impossible.

That is, in the aforedescribed lever type under item A, unless the trailing end of the sheet passes the tip end of the pushed-down lever, the lever does not return to its original position and therefore, at least the spacing between sheets substantially corresponding to the length of the lever is necessary (La), and further the time required for the lever to return to its original position becomes 10 msec.

This time results in greater loss of the spacing between sheets as the sheet conveying speed becomes higher, and when for example, the time for the lever to return to its original position is 30 msec. and the sheet conveying speed is 500 mm/S, a sheet conveyance spacing of 15 mm becomes further necessary.

C. In the transmission type sensor, the loss may be smaller than in the lever type, but the spacing of about 5 mm between sheets is necessary.

Also, in the case of the transmission type sensor, detection has sometimes been impossible for sheets such as OHP having high transmissivity.

Accordingly, when the spacing between sheets is made as minute as the leading and trailing ends of the sheet cannot be detected by the aforedescribed detecting means or zero or less, the detection of bad conveyance for sheet conveyance becomes impossible.

That is, by shortening the spacing between sheets, it becomes possible to increase productivity, but by the spacing between sheets becoming short, it becomes impossible to detect the trailing ends of the other sheets than the last sheet and the leading ends of the second and subsequent sheets by the sheet detecting means and as the result, in some cases, bad conveyance cannot be detected until the recording of a designated number of sheets is finished, and in such cases, there has also been the undesirable possibility that a large quantity sheets stagnate in the bad conveying portion to thereby provide badly recorded sheets and impart damage to the machine.

SUMMARY OF THE INVENTION

The present invention has been made in order to solve the above-noted problems peculiar to the prior art and the object thereof is to provide a sheet conveying apparatus and an image forming apparatus excellent in reliability which maintain high productivity and yet can quickly detect bad conveyance when it occurs.

To achieve the above object, according to the present invention, in a sheet conveying apparatus capable of continuously conveying sheets substantially without gaps, after a predetermined number of sheets have been conveyed, the next sheet is conveyed after a predetermined spacing is forcibly provided.

Accordingly, the predetermined spacing is forcibly provided and therefore, the detection of the passage of the leading ends or the trailing ends of the sheets with a predetermined number of sheets as a unit becomes possible.

When the designated number of sheets to be conveyed is greater than the aforementioned predetermined number of sheets, the operation of conveying the next sheet after the predetermined spacing has been provided may be repeated each time the predetermined number of sheets are conveyed.

Provision may be made of detecting means for detecting the passage of the leading end of the first sheet and the passage of the trailing end of the last sheet when a plurality of sheets are continuously conveyed substantially without gaps, and the bad conveyance of the sheets may be detected from the result of the detection by the detecting means.

The aforedescribed detecting means includes first detecting means for detecting the passage of the sheets on the upstream side with respect to the direction of conveyance, and second detecting means for detecting the passage of the sheets on the downstream side of the detecting position by the first detecting means, and the spacing between the detecting position by the first detecting means and the detecting position by the second detecting means may be greater than the distance from the leading end of the first sheet to the trailing end of the last sheet when the predetermined number of sheets are continuously conveyed substantially without gaps.

Thereby, the state of bad conveyance can be known.

When the spacing between the detecting position by the first detecting means and the detecting position by the second detecting means is defined as Lp and the length of the conveyed sheet in the direction of conveyance is defined as LS, if the aforementioned predetermined number is N, N may be set so as to satisfy $$Lp>Ls\times N.$$

Also, N may be set so as to satisfy $$Ls\times(N+1)>Lp>Ls\times N.$$

Also, the image forming apparatus of the present invention is provided with image forming means for forming images on the sheets conveyed by the above-described sheet conveying apparatus.

DESCRIPTION OF THE PREFERRED EMBODIMENT

A preferred embodiment of this invention will hereinafter be exemplarily described in detail with reference to the drawings. However, the dimensions, materials, shapes, relative dispositions, etc. of constituent parts described in this embodiment, unless specifically described, are not intended to be restrictive within the scope of this invention.

A sheet conveying apparatus and an image forming apparatus according to the embodiment of the present invention will hereinafter be described with reference to FIGS. 1, 3A, 3B, 3C, 3D and 3E.

In the following, description will be made with respect to a case where the sheet conveying apparatus according to the embodiment of the present invention is applied to a copier of the electrophotographic type.

Figure 1:
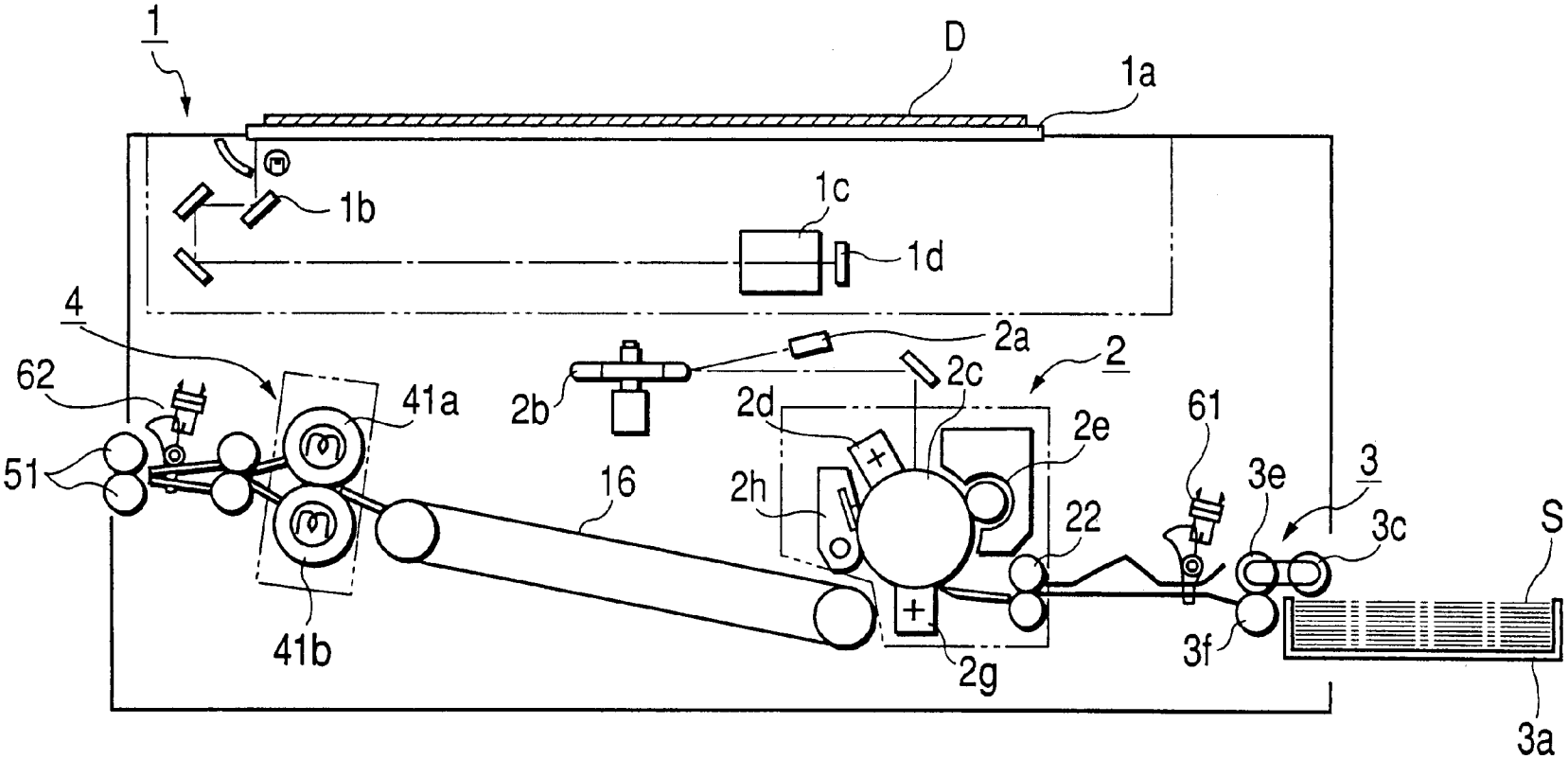
FIG. 1 is a cross-sectional view schematically showing the construction of an image forming apparatus according to an embodiment of the present invention.

FIG. 1 is a cross-sectional view schematically showing the construction of the image forming apparatus (copier) according to the embodiment of the present invention.

Reference is first bad to FIG. 1 to schematically describe the construction of the copier.

The copier photoelectrically converts image information read by a reader portion 1 having a scanning optical system and forwards it to an image forming portion 2 provided with image forming means, and in the image forming portion 2, image formation is effected on a sheet S fed by a sheet feeding portion 3.

After the image formation, the sheet S is conveyed to a fixing device 4, and heat and pressure are applied to the sheet S, whereby the transferred image thereon is fixed.

A series of electrophotographic process steps are known and therefore need not be described in detail.

(Reader Portion)

An original D resting on an original glass plate 1*a* is irradiated with light by a scanning optical system 1*b* having a light source and a group of reflecting mirrors, and the reflected light therefrom is imaged on a CCD 1*d* through a reducing lens 1*c* and is subjected to photoelectric conversion, and is A/D-converted, whereafter this image information is forwarded to a memory.

(Printer Portion)

Sheets S are stacked and contained in a sheet feeding cassette 3*a* capable of stacking sheets of different sizes thereon, and the sheet feeding cassette 3*a* is detachably mounted on the lower portion of the copier.

The sheet conveying apparatus according to the embodiment of the present invention is designed to be capable of conveying the sheets at a zero spacing between the sheets.

The operation of conveying the sheets at the zero spacing between the sheets will hereinafter be described with reference to FIGS. 2A, 2B, 2C, 2D and 2E.

Figure 2A:
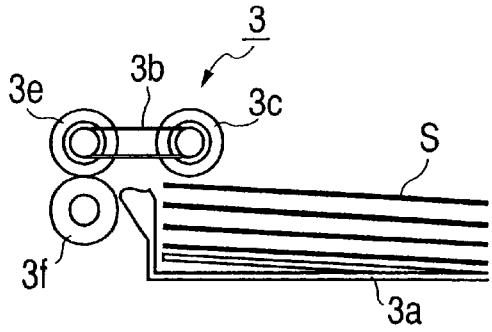
FIGS. 2A, 2B, 2C, 2D and 2E are illustrations of the operation when sheets are continuously conveyed substantially without gaps.

A solenoid (not shown) connected to a pickup roller 3*c* is ON during waiting, and the pickup roller 3*c* is spaced apart from the surface of the sheet (see FIG. 2A).

Next, when the sheets are to be fed, the solenoid becomes OFF and the pickup roller 3*c* comes into contact with the surface of the sheet.

The feeding of the first sheet is then effected by the pickup roller 3*c* being rotatively driven.

Figure 2B:
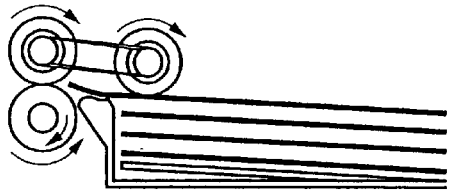

The driving of the pickup roller 3*c* is transmitted from a conveying roller 3*e* through a timing belt 3*b* (see FIG. 2B).

Figure 2C:
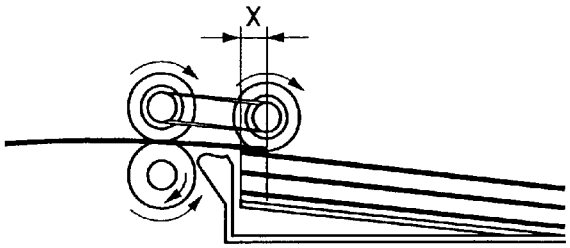

When the trailing end of the first sheet arrives at the pickup roller 3*c*, the second sheet is fed while overlapping by X because the pickup roller 3*c* remains in contact with the surface of the sheet (see FIG. 2C).

On the other hand, the sheet is nipped and conveyed by the conveying roller 3*e* and a retard roller 3*f*.

Here, the conveying roller 3*e* is being rotatively driven in the direction of conveyance of the sheets, and the retard roller 3*f* is being rotatively driven in a direction opposite to the direction of conveyance by a torque limiter (not shown).

Consequently, only one sheet is present between the two rollers on the leading end side of the first sheet and therefore, the torque limiter is overcome by the frictional force between the sheet and the rollers and the retard roller 3*f* is rotated in the direction of conveyance.

Next, when the X portion on the trailing end side where the sheets overlap each other arrives at the nip portion between the two rollers, the frictional force between the first sheet and the second sheet is overcome by the torque limiter and the retard roller 3*f* is rotated in the direction reverse to the direction of conveyance and therefore, only the uppermost sheet precedes and is separated and fed.

Figure 2D:
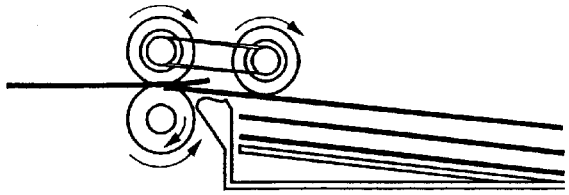

Even if a plurality of sheets S are picked up, only the uppermost sheet precedes and is separated and fed by a similar operation (see FIG. 2D).

Figure 2E:
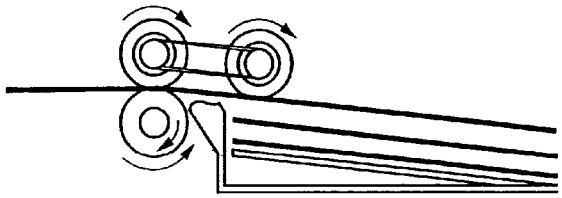

The overlapping portions of the sheets are separated from each other, and the sheets are repetitively fed successively at a spacing of zero (0) between the sheets or at such a degree of minute spacing that cannot be detected by a sensor, and when a predetermined number of sheets have been fed, the driving is stopped to thereby release the pickup roller 3*c* (see FIG. 2E).

After the lapse of a predetermined time after the pickup roller 3*c* has been stopped, the pickup roller 3*c* is driven again.

Alternatively, the pickup roller 3*c* may be driven again after the trailing end of the last one of the continuously fed sheets has been detected by a sheet feeding sensor 61.

The leading end of the sheet fed next may have arrived at the nip between the conveying roller 3*e* and the retard roller 3*f*, or may stay on the fore end portion of the sheet feeding cassette 3*a*, or may be therebetween. Accordingly, the spacing between the preceding group of sheets and the succeeding group of sheets is irregular.

The irregularity, however, is within the range of the distance between the nip between the conveying roller 3*e* and the retard roller 3*f* and the fore end portion of the sheet feeding cassette 3*a*. Consequently, the spacing between the preceding group of sheets and the succeeding group of sheets is within a predetermined distance.

The spacing may be left as it is, but it can also be adjusted by registration rollers 22 and be made constant. That is, the leading end of the foremost sheet of each group of sheets fed by the pickup roller 3*c* is restrained by the registration rollers 22 stopped to thereby form a loop and correct skew feed. Nest, the registration rollers 22 are driven to effect the conveyance of the sheets. If at this time, the interval between the starts of the driving of the registration rollers 22 for the respective groups of sheets is made constant, the spacing between the respective groups of sheets will become a constant distance.

(Conveying Portion)

The sheets fed by the sheet feeding portion 3 are conveyed to the image forming portion 2 by the registration rollers 22, and the transfer of an image is effected there.

(Image Forming Portion)

The image information read by the reader portion 1 is irradiated with a laser beam emitted from a laser beam emitting portion 2*a* by a laser driver.

The laser beam is then scanned in the direction of the bus line of a photosensitive drum 2*c* by the rotation of a polygon mirror 2*b* to thereby form a latent image on the surface of the drum pre-charged by a charger 2*d*.

This latent image is developed by a developing device 2*e* provided around the photosensitive drum 2*c*, and a toner image is transferred by a transfer charger 2*g* to the sheet S conveyed by the registration rollers 22.

Any toner residual on the surface of the drum after the transfer of the image is removed by a cleaning device 2*b*.

(Fixing Portion)

The sheet S to which the toner image has been transferred in the image forming portion 2 is directed to the fixing device 4 by a conveying belt 16, and heat and pressure are applied to the sheet S when it passes between a pair of fixing rollers 41*a* and 41*b* to thereby fuse and bond the toner image on the sheet S.

(Discharge Portion)

The sheet S after the image thereon has been fixed is discharged out of the apparatus through a pair of discharge rollers 51.

The image forming apparatus provided with the sheet conveying apparatus according to the present embodiment is constructed as described above, and when images are to be continuously formed on a plurality of sheets, the above-described operation is repetitively performed.

In the present embodiment, a sheet feeding sensor 61 as first detecting means is provided near the downstream side of the conveying roller 3*e* and the retard roller 3*f*, and a sheet discharge sensor 62 as second detecting means is provided near the upstream side of the pair of discharge rollers 51.

Also, in the sheet conveying apparatus according to the embodiment of the present invention, after a predetermined number of sheets have been conveyed with the zero spacing between the sheets (continuously conveyed substantially without gaps), the next sheet is conveyed with a predetermined spacing forcibly provided.

When here, the length of the sheet S in the direction of conveyance is defined as Ls and the conveyance distance between the sheet feeding sensor 61 and the sheet discharge sensor 62 is defined as Lp and the number of sheets conveyed at a spacing of zero (0) between the sheets at a time is defined as N, N is set so that $$Lp>Ls\times N.$$

That is, when the designated number of sheets is N or greater, N sheets as a set are conveyed at a spacing of zero (0) between the sheets, whereafter N sheets as a set are again conveyed at a predetermined spacing detectable by the sensor provided between the sheets, and this is repeated.

If N is determined so as to satisfy $$Ls\times(N+1)>Lp>Ls\times N,$$

the maximum number of sheets continuously conveyed at a spacing of zero (0) between the sheets can be increased.

For example, when

Lp=900 mm and

Ls=210 mm (A4 size),

N=4 (sheets).

Also, conveyance is effected with the spacing between respective sets of sheets as 40 mm.

Here, the mode when bad conveyance has occurred is grouped as follows:

A case where the leading end of the first sheet of each set is delayed relative to the sheet feeding sensor 61, a case where the trailing end of the last sheet of each set stagnates, a case where the leading end of the first sheet of each set is delayed relative to the sheet discharge sensor 62, and a case where the trailing end of the last sheet of each set stagnates.

The state of bad conveyance will hereinafter be described with reference to FIGS. 3A, 3B, 3C, 3D and 3E in which the positions of the sensors and the sheets are simplified and typically shown.

In these figures, the actual positions of the sheets are indicated by solid lines, the encircled numerals represent the order of sheet feeding in each set (in the order of (1), (2), (3) and (4) with four sheets as a set), the positions at which the sheets should originally be are indicated by underlying broken lines, and encircled numerals in parentheses represent the order of sheet feeding in each set (in the order of [(1)], [(2)], [(3)] and [(4)] with four sheets as a set).

In each of these figures, the sheets are shown as being alternately vertically shifted for the convenience of illustration in order to clarify their positions during conveyance.

Figure 3A:
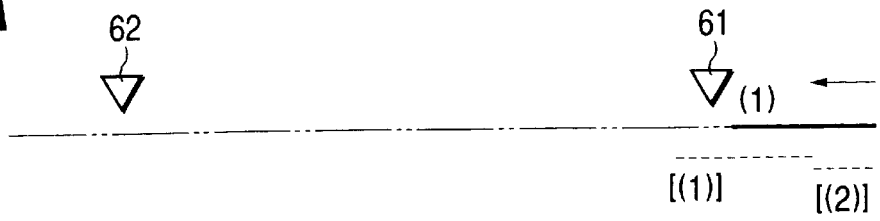
FIGS. 3A, 3B, 3C, 3D and 3E are typical views typically showing the state of bad conveyance in a sheet conveying apparatus according to an embodiment of the present invention.

FIG. 3A shows a case where the leading end of the first sheet of each set is delayed relative to the sheet feeding sensor 61, that is, a state in which at predetermined timing, the sheet has not arrived at the sheet feeding sensor 61.

Figure 5:
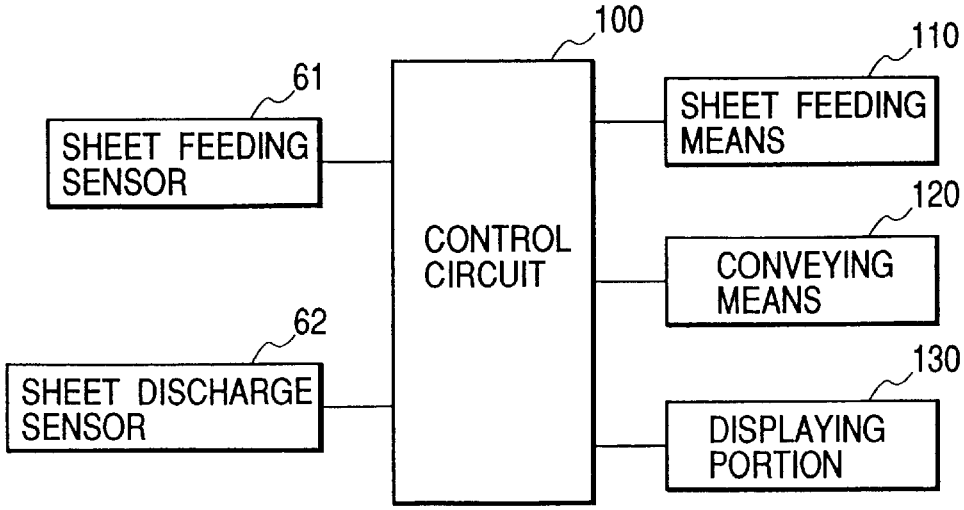
FIG. 5 is a block diagram of a control device for controlling the conveyance of the sheets.

In this case, the second and subsequent sheets are not yet fed and therefore, the second and subsequent sheets have no relation, and a control circuit 100 shown in FIG. 5 simply judges the bad feeding (delay) of the first sheet, and detects it as bad sheet feeding as in an apparatus for feeding sheets at an ordinary spacing between the sheets, and performs a predetermined operation.

Figure 3B:
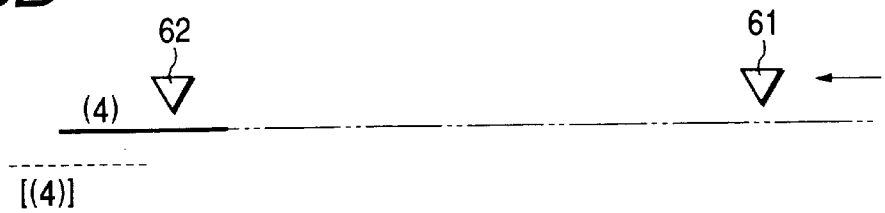

FIG. 3B shows a case where the trailing end of the last sheet of each set stagnates relative to the sheet discharge sensor 62. That is, at predetermined timing whereat the trailing end of the sheet ought to be passing, the sheet discharge sensor 62 detects the sheet and therefore, the control circuit 100 judges the stagnation of the sheet.

In this case, the second and subsequent sheets are considered to have come to be badly conveyed for some reason or other, and at a point of time whereat the bad conveyance could be detected from the stagnation of the trailing end of the fourth sheet, the apparatus is stopped as bad conveyance, whereafter a predetermined operation is performed.

Figure 3C:
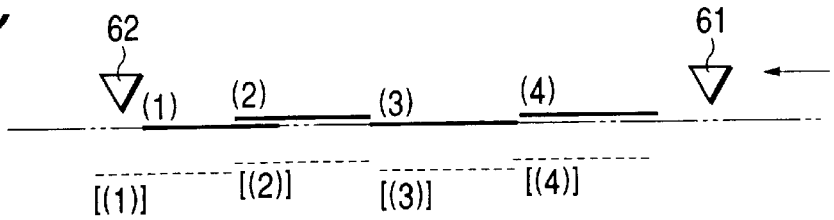

FIG. 3C shows the state in a case where at predetermined timing, the sheet discharge sensor 62 does not detects the leading end of the first sheet of each group of sheets and the trailing end of the last sheet of each set has passed the sheet feeding sensor 61 at regular timing.

In this case, the control circuit 100 judges that the first sheet has caused bad conveyance. There is conceivable a case where the leading end of the first sheet is delayed relative to the sheet discharge sensor and the sheet is conveyed without the sheet feeding sensor 61 portion being abnormal and the sheets overlap on the conveying path between the two sheets or the first sheet is caught somewhere, whereby the apparent length of the sheet has become short.

Figure 3D:
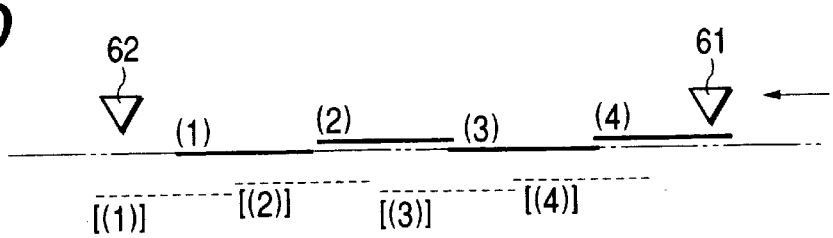

FIG. 3D shows the state in a case where the sheet discharge sensor 62 does not detect the leading end of the first sheet of each set at the timing whereat it should arrive there and the sheet feeding sensor 61 has detected the trailing end of the last sheet at the timing whereat it has passed.

In this case, the control circuit 100 can judge that the bad conveyance of the sheet has occurred on the conveying path downstream of the sheet feeding sensor 61 and the entire sheet is delayed relative to its original position.

Figure 3E:
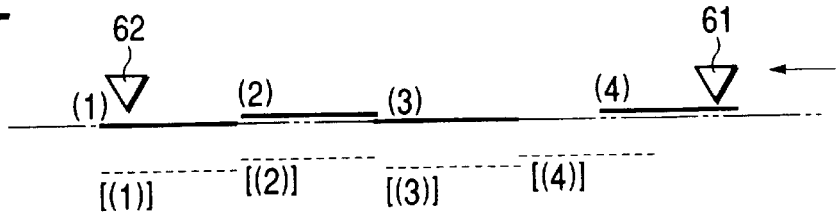
Figure 4A:
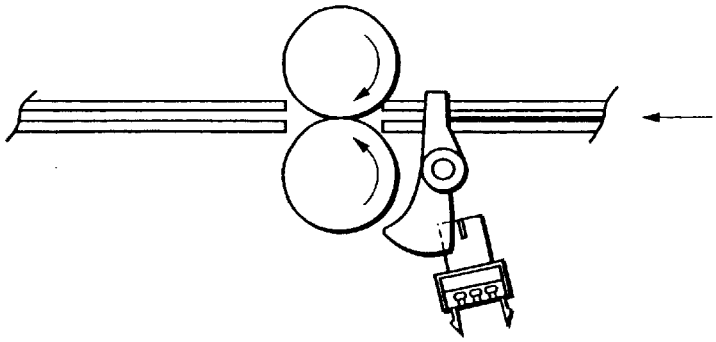
FIGS. 4A and 4B are schematic illustrations showing a sheet detecting method of the lever type.
Figure 4B:
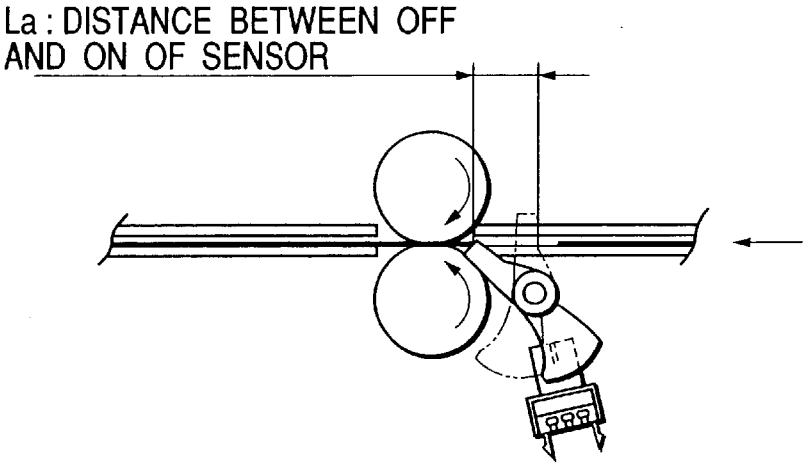

FIG. 3E shows the state in a case where the leading end of the first sheet of each set passes the sheet discharge sensor 62 at regular timing and the timing of the trailing end of the last sheet of each set relative to the sheet feeding sensor 61 is delayed.

In this case, it can be considered that on the downstream side of the sheet feeding sensor 61, the second and subsequent sheets are generally delayed (in FIG. 3E, the fourth sheet is shown as being delayed) due to some abnormality during the conveyance of the sheets and at some locations, the spacing between the sheets is not zero (0).

Discretely from this, when the distance between the sheets has been widened by bad conveyance, the portion between the sheets which originally cannot be detected by the sensors can be detected, whereby bad conveyance can be detected.

Thus, the total conveyance length of the continuously conveyed sheets is shorter than the conveyance distance between the sheet feeding sensor and the sheet discharge sensor, whereby it becomes possible to detect which portion has caused bad conveyance.

By the above-described method, the control circuit 100 judges whether the bad conveyance of the sheets has occurred, from the result of the detection of the presence or absence of the sheets by the sheet feeding sensor 61 and the sheet discharge sensor 62 at preset timing. Or it judges whether the bad conveyance has occurred, by at what timing, the sheet feeding sensor 61 and the sheet discharge sensor 62 having detected the leading end or the trailing end of the sheet.

When it judges that bad conveyance has occurred, the control circuit 100 stops the driving of sheet feeding means 110 and conveying means 120. Also, it specifies the location at which the sheet is present, performs a predetermined bad conveyance sequence and effects the display of JAM on a displaying portion 130 to the user, whereby it becomes possible for the user to effect the clearance of the sheet.

Here, the productivity when four sheets as a block are conveyed at a spacing of zero (0) between the sheets will be considered.

Assuming that the conveyance speed of the sheets is 125 mm/sec., when the spacing between the sheets is always 40 mm, the number of sheets is 125×60/(210+40)=30 sheets/min., and when the spacing between the sheets is 0 mm, the number of sheets is 125×60/210=35.71 sheets/min., and when four sheets are conveyed at a spacing of 0 and the spacing with respect to the next block is 40 mm, the number of sheets is (125×60/(210×4+40))×4=34.09 sheets/min., and it is possible to have a conveying property enabling jam detection to be done and yet have high productivity without so much decreasing the productivity relative to the productivity when the spacing between the sheets is made zero (0).

While in the foregoing, an apparatus coping with the sheets of A4 size has been described, the present invention can also cope with a sheet conveying apparatus (or an image forming apparatus provided with a sheet conveying apparatus) capable of conveying a plurality of kinds of sheets differing in size.

Description will hereinafter be made, for example, an apparatus in which sheets of A4 size and A3 size are used.

In this case, when as described above, Lp=900 mm, Ls=210 mm (A4 size) and Ls=420 mm (A3 size), and N=4 (A4 size) and N=2 (A3 size).

Accordingly, when the sheets of A4 size are to be conveyed, four sheets as a predetermined number of sheets to be fed are continuously fed at a spacing of zero (0) between the sheets, and when the sheets of A3 size are to be conveyed, two sheets as a predetermined number of sheets to be fed are continuously fed at a spacing of zero (0) between the sheets.

By thus setting the predetermined number of sheets to be fed in conformity with the size of the sheets, an effect similar to that in the above-described cases can be obtained irrespective of the size.

Also, in the foregoing description, the bad conveyance of the sheets has been detected by the use of the sensors provided at a location downstream of the sheet discharge portion and a location upstream of the sheet discharge portion, but of course the disposed locations of the sensors are not restricted in particular if a necessary distance can be secured between the two sensors.

In the above-described embodiment, description has been made of an example in which a predetermined number of sheets are continuously fed at a spacing of zero mm or such a degree of minute spacing that cannot be detected by the sheet sensors, and are conveyed at a predetermined or less spacing between the continuously fed groups of sheets. However, a series of groups of sheets may be continuously fed in such a manner that the sheets in the groups overlap each other by a minute length, and may be conveyed at a predetermined or less spacing between the groups of sheets.

In this case, the driving of the retard roller 3*f* is stopped in the state between FIG. 2D and FIG. 2E so as not to give a conveying force in the opposite direction to the succeeding sheets. Thus, the sheets are conveyed with the leading end of the succeeding sheet overlapping the preceding sheet.

As described above, according to the present invention, a predetermined number of sheets are continuously conveyed substantially without gaps, whereby high productivity is maintained, and after the predetermined number of sheets have been conveyed, sheets are conveyed next after a predetermined spacing is forcibly provided and therefore, the detection of the passage of the leading end or the trailing end of the predetermined number of sheets as a unit becomes possible, and when bad conveyance occurs, it can be quickly detected, and the present invention is excellent in reliability.

The distance between the detecting position by the first detecting means and the detecting position by the second detecting means is greater than the distance from the leading end of the first sheet to the trailing end of the last sheet when a predetermined number of sheets are continuously conveyed substantially without gaps, whereby the state of bad conveyance can be known.

What is claimed is:

1. A sheet conveying apparatus comprising:

means for continuously conveying sheets substantially without gaps; and control means for controlling the sheet conveyance so that after a predetermined number of sheets have been conveyed, the next sheet is conveyed after a predetermined spacing is provided, wherein when sheets of a number more than said predetermined number are continuously conveyed, said control means performs a repeating control in that the next predetermined number of sheets are conveyed substantially without gaps after said predetermined spacing is provided each time said predetermined number of sheets have been conveyed substantially without gaps.

2. A sheet conveying apparatus according to claim 1, wherein when a plurality of sheets are continuously conveyed substantially without gaps, provision is made of detecting means for detecting the passage of the leading end of the first sheet and the passage of the trailing end of the last sheet, and the bad conveyance of the sheets is detected from the result of the detection by said detecting means.

3. A sheet conveying apparatus according to claim 2, wherein said detecting means includes first detecting means for detecting the passage of the sheets on the upstream side with respect to the direction of conveyance, and second detecting means for detecting the passage of the sheets on the downstream side of the detecting position by said first detecting means, and the distance between the detecting position by said first detecting means and the detecting position by said second detecting means is greater than the distance from the leading end of the first sheet to the trailing end of the last sheet when said predetermined number of sheets are continuously conveyed substantially without gaps.

4. A sheet conveying apparatus according to claim 3, wherein when the distance between the detecting position by said first detecting means and the detecting position by said second detecting means is defined as Lp and the length of the conveyed sheet in the direction of conveyance thereof is defined as Ls, if said predetermined number is N, N is set so as to satisfy $$Lp>Ls\times N.$$

5. A sheet conveying apparatus according to claim 4, wherein N is set so as to satisfy $$Ls\times(N+1)>Lp>Ls\times N.$$

6. An image forming apparatus provided with image forming means for forming images on the sheets conveyed by a sheet conveying apparatus according to any one of claims 1 to 5.

7. A sheet conveying apparatus according to any one of claims 1 to 5, wherein said predetermined number of sheets are continuously conveyed at such a degree of spacing that cannot be detected by a sensor.

8. A sheet conveying apparatus according to any one of claims 1 to 5, wherein said predetermined number of sheets are continuously conveyed in a state in which they overlap one another by a minute length.

9. A sheet conveying apparatus according to claim 1, wherein said predetermined spacing is a distance within a predetermined range.

10. A sheet conveying apparatus comprising:

a sheet feeding roller contacting with a sheet stack and rotated to thereby feed sheets from the stack;

conveying means for conveying the sheets fed by said sheet feeding roller; and control means for controlling said sheet feeding roller so that when sheets of a number more than a predetermined number are continuously conveyed by said sheet feeding roller, said sheet feeding roller may be continuously rotated without being stopped to thereby continuously feed the predetermined number of sheets from said stack, and after the predetermined number of sheets have been fed, said sheet feeding roller may be stopped, whereafter it may be rotated to thereby feed the next sheet.

11. A sheet conveying apparatus according to claim 10, wherein said control means controls said sheet feeding roller so that after a predetermined number of sheets have been continuously fed by said sheet feeding roller being continuously rotated without being stopped, said sheet feeding roller may be stopped, whereafter said sheet feeding roller may be continuously rotated again without being stopped to thereby continuously feed a predetermined number of sheets from said stack.

12. A sheet conveying apparatus according to claim 10, wherein provision is made of detecting means for detecting the passage of the leading end of the first sheet or the passage of the trailing end of the last sheet of the predetermined number of sheets continuously fed by said sheet feeding roller being continuously rotated without being stopped, and said control means detects the bad conveyance of the sheets from the result of the detection by said detecting means.

13. A sheet conveying apparatus according to claim 10, wherein provision is made of detecting means for detecting the passage of the leading end of the first sheet or the passage of the trailing end of the last sheet of the predetermined number of sheets continuously fed by said sheet feeding roller being continuously rotated without being stopped, and said control means detects the bad conveyance of the sheets when at preset predetermined timing, the detection of the passage of the leading end of the first sheet or the passage of the trailing end of the last sheet is not effected by said detecting means.

14. A sheet conveying apparatus according to claim 10, wherein provision is made of detecting means for detecting the passage of the leading end of the first sheet or the passage of the trailing end of the last sheet of the predetermined number of sheets continuously fed by said sheet feeding roller being continuously rotated without being stopped, and said control means stops the conveyance of the sheets by said conveying means when at preset predetermined timing, the detection of the passage of the leading end of the first sheet or the passage of the trailing end of the last sheet is not effected by said detecting means.

15. A sheet conveying apparatus according to claim 10, further having detecting means for detecting the presence or absence of the sheets, and wherein said control means detects the bad conveyance of the sheets by said conveying means when said detecting means detects the absence of the sheets in the course of the passage of the predetermined number of sheets continuously fed by said sheet feeding roller being continuously rotated without being stopped.

16. A sheet conveying apparatus according to claim 10, further having detecting means for detecting the presence or absence of the sheets, and wherein said control means stops the conveyance of the sheets by said conveying means when said detecting means detects the absence of the sheets in the course of the passage of the predetermined number of sheets continuously fed by said sheet feeding roller being continuously rotated without being stopped.

17. A sheet conveying apparatus according to claim 10, further having detecting means for detecting a spacing equal to or greater than a predetermined distance between the sheets continuously conveyed, and wherein said control means detects bad conveyance when said detecting means detects the spacing equal to or greater than the predetermined distance in the course of the passage of the predetermined number of sheets continuously fed by said sheet feeding roller being continuously rotated without being stopped.

18. A sheet conveying apparatus according to claim 10, further having detecting means for detecting a spacing equal to or greater than a predetermined distance between the sheets continuously conveyed, and wherein said control means stops the conveyance of the sheets by said conveying means when said detecting means detects the spacing equal to or greater than the predetermined distance in the course of the passage of the predetermined number of sheets continuously fed by said sheet feeding roller being continuously rotated without being stopped.

19. A sheet conveying apparatus according to claim 10, wherein said predetermined number is set in conformity with the size of the sheets.

20. A sheet conveying apparatus comprising:

a sheet feeding roller contacting with a sheet stack and rotated to thereby feed sheets from the stack;

conveying means for conveying the sheets fed by said sheet feeding roller;

control means for controlling said sheet feeding roller so that said sheet feeding roller may be continuously rotated without being stopped to thereby continuously feed a predetermined number of sheets from said stack, and after the predetermined number of sheets have been fed, said sheet feeding roller may be stopped, and thereafter said sheet feeding roller may be rotated to feed a next sheet; and detecting means for detecting a passage of a leading end of a first sheet or a passage of a trailing end of a last sheet of the predetermined number of sheets continuously fed by said sheet feeding roller being continuously rotated without being stopped, wherein said control means detects a bad conveyance of the sheets from a result of detection by said detecting means.

21. A sheet conveying apparatus comprising:

a sheet feeding roller contacting with a sheet stack and rotated to thereby feed sheets from the stack;

conveying means for conveying the sheets fed by said sheet feeding roller;

control means for controlling said sheet feeding roller so that said sheet feeding roller may be continuously rotated without being stopped to thereby continuously feed a predetermined number of sheets from said stack, and after the predetermined number of sheets have been fed, said sheet feeding roller may be stopped, and thereafter said sheet feeding roller may be rotated to feed a next sheet; and detecting means for detecting a passage of a leading end of a first sheet or a passage of a trailing end of a last sheet of the predetermined number of sheets continuously fed by said sheet feeding roller being continuously rotated without being stopped, wherein said control means detects a bad conveyance of the sheets when at preset predetermined timing, a detection of the passage of the leading end of the first sheet or the passage of the trailing end of the last sheet is not effected by said detecting means.

22. A sheet conveying apparatus comprising:

a sheet feeding roller contacting with a sheet stack and rotated to thereby feed sheets from the stack;

conveying means for conveying the sheets fed by said sheet feeding roller;

control means for controlling said sheet feeding roller so that said sheet feeding roller may be continuously rotated without being stopped to thereby continuously feed a predetermined number of sheets from said stack, and after the predetermined number of sheets have been fed, said sheet feeding roller may be stopped, and thereafter said sheet feeding roller may be rotated to feed a next sheet; and detecting means for detecting a passage of a leading end of a first sheet or a passage of a trailing end of a last sheet of the predetermined number of sheets continuously fed by said sheet feeding roller being continuously rotated without being stopped, and said control means stops a conveyance of the sheets by said conveying means when at preset predetermined timing, a detection of the passage of the leading end of the first sheet or the passage of the trailing end of the last sheet is not effected by said detecting means.

23. A sheet conveying apparatus comprising:

a sheet feeding roller contacting with a sheet stack and rotated to thereby feed sheets from the stack;

conveying means for conveying the sheets fed by said sheet feeding roller;

control means for controlling said sheet feeding roller so that said sheet feeding roller may be continuously rotated without being stopped to thereby continuously feed a predetermined number of sheets from said stack, and after the predetermined number of sheets have been fed, said sheet feeding roller may be stopped, and thereafter said sheet feeding roller may be rotated to feed a next sheet; and detecting means for detecting a presence or absence of the sheets, wherein said control means detects a bad conveyance of the sheets by said conveying means when said detecting means detects the absence of the sheets in a course of passage of the predetermined number of sheets continuously fed by said sheet feeding roller being continuously rotated without being stopped.

24. A sheet conveying apparatus comprising:

a sheet feeding roller contacting with a sheet stack and rotated to thereby feed sheets from the stack;

conveying means for conveying the sheets fed by said sheet feeding roller;

control means for controlling said sheet feeding roller so that said sheet feeding roller may be continuously rotated without being stopped to thereby continuously feed a predetermined number of sheets from said stack, and after the predetermined number of sheets have been fed, said sheet feeding roller may be stopped, and thereafter said sheet feeding roller may be rotated to feed a next sheet; and detecting means for detecting a presence or absence of the sheets, wherein said control means stops a conveyance of the sheets by said conveying means when said detecting means detects the absence of the sheets in a course of passage of the predetermined number of sheets continuously fed by said sheet feeding roller being continuously rotated without being stopped.

25. A sheet conveying apparatus comprising:

a sheet feeding roller contacting with a sheet stack and rotated to thereby feed sheets from the stack;

conveying means for conveying the sheets fed by said sheet feeding roller;

control means for controlling said sheet feeding roller so that said sheet feeding roller may be continuously rotated without being stopped to thereby continuously feed a predetermined number of sheets from said stack, and after the predetermined number of sheets have been fed, said sheet feeding roller may be stopped, and thereafter said sheet feeding roller may be rotated to feed a next sheet; and detecting means for detecting a spacing equal to or greater than a predetermined distance between the sheets continuously conveyed, wherein said control means detects a bad conveyance when said detecting means detects the spacing equal to or greater than the predetermined distance in a course of the passage of predetermined number of sheets continuously fed by said sheet feeding roller being continuously rotated without being stopped.

26. A sheet conveying apparatus comprising:

a sheet feeding roller contacting with a sheet stack and rotated to thereby feed sheets from the stack;

conveying means for conveying the sheets fed by said sheet feeding roller;

control means for controlling said sheet feeding roller so that said sheet feeding roller may be continuously rotated without being stopped to thereby continuously feed a predetermined number of sheets from said stack, and after the predetermined number of sheets have been fed, said sheet feeding roller may be stopped, and thereafter said sheet feeding roller may be rotated to feed a next sheet; and detecting means for detecting a spacing equal to or greater than a predetermined distance between the sheets continuously conveyed, wherein said control means stops a conveyance of the sheets by said conveying means when said detecting means detects the spacing equal to or greater than the predetermined distance in a course of passage of the predetermined number of sheets continuously fed by said sheet feeding roller being continuously rotated without being stopped.

27. A sheet conveying apparatus comprising:

a sheet feeding roller contacting with a sheet stack and rotated to thereby feed sheets from the stack;

conveying means for conveying the sheets fed by said sheet feeding roller; and control means for controlling said sheet feeding roller so that said sheet feeding roller may be continuously rotated without being stopped to thereby continuously feed a predetermined number of sheets from said stack, and after the predetermined number of sheets have been fed, said sheet feeding roller may be stopped, and thereafter said sheet feeding roller may be rotated to feed a next sheet, wherein said predetermined number is set in conformity with a size of the sheets.

* * * * *

UNITED STATES PATENT AND TRADEMARK OFFICE

CERTIFICATE OF CORRECTION

PATENT NO. : 6,382,618 B1
DATED : May 7, 2002
INVENTOR(S) : Hideaki Takada

It is certified that error appears in the above-identified patent and that said Letters Patent is hereby corrected as shown below:

Column 3,
Line 27, "LS," should read -- $L_S$, --.

Column 4,
Line 10, "bad" should read -- made --.

Column 14,
Line 1, "of" (2nd occurrence) should read -- of the --.

Signed and Sealed this

Twenty-third Day of July, 2002

*Attest:*

*Attesting Officer*

JAMES E. ROGAN
*Director of the United States Patent and Trademark Office*